US005916317A

United States Patent [19]

Willoughby et al.

[11] Patent Number: 5,916,317

[45] **Date of Patent: *Jun. 29, 1999**

[54] METAL CONTAINER BODY SHAPING/ EMBOSSING

[75] Inventors: Otis Willoughby, Boulder; Greg Robinson, Louisville, both of Colo.

[73] Assignee: Ball Corporation, Broomfield, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/582,866

[22] Filed: Jan. 4, 1996

[51] Int. Cl.[6] ..... B21D 26/02

[52] U.S. Cl. ..... 72/61; 72/62; 29/421.1

[58] Field of Search ..... 72/54, 56, 61, 72/62, 63; 29/421.1

[56] References Cited

U.S. PATENT DOCUMENTS

| | | | |
|---|---|---|---|
| 10,934 | 5/1854 | Hobson . | |
| Re. 24,833 | 5/1960 | Peccerill | 113/44 |
| 392,977 | 11/1888 | Langerfeld . | |
| 429,349 | 6/1890 | Hobson et al. . | |
| 464,736 | 12/1891 | Stapley . | |
| 464,737 | 12/1891 | Stapley . | |
| 1,310,118 | 7/1919 | Greenfield et al. . | |
| 1,711,445 | 4/1929 | Burvenick . | |
| 1,727,918 | 9/1929 | Ziegler . | |
| 1,766,098 | 6/1930 | Booth . | |
| 1,847,794 | 3/1932 | Takeda . | |
| 1,919,869 | 7/1933 | Stanitz et al. . | |
| 2,354,564 | 7/1944 | Wiley | 18/45 |
| 2,407,855 | 9/1946 | Stephens | 113/44 |
| 2,426,949 | 9/1947 | Puster | 153/73 |
| 2,592,867 | 4/1952 | Cuq | 113/44 |
| 2,649,067 | 8/1953 | Kranenberg | 113/44 |
| 2,742,873 | 4/1956 | Moore | 113/44 |
| 2,743,691 | 5/1956 | Cuq | 113/44 |
| 2,787,973 | 4/1957 | Heidmann | 113/44 |
| 2,966,872 | 1/1961 | Schmocker | 113/44 |
| 3,094,091 | 6/1963 | Peccerill | 113/44 |
| 3,220,235 | 11/1965 | Peccerill | 72/62 |
| 3,222,902 | 12/1965 | Brejcha et al. | 72/56 |
| 3,224,239 | 12/1965 | Hansson | 72/62 |
| 3,228,222 | 1/1966 | Maier | 72/56 |
| 3,236,080 | 2/1966 | Illgen | 72/56 |
| 3,252,312 | 5/1966 | Maier | 72/56 |
| 3,256,846 | 6/1966 | Keinanen | 113/120 |
| 3,376,723 | 4/1968 | Chelminski | 72/56 |

(List continued on next page.)

FOREIGN PATENT DOCUMENTS

| | | | |
|---|---|---|---|
| 94344 | 4/1983 | European Pat. Off. . | |
| 2047055 | 9/1970 | Germany . | |
| 145504 | 8/1979 | Germany . | |
| 22138 | 10/1939 | Japan . | |
| 4934 | 2/1972 | Japan . | |
| 54223 | 4/1980 | Japan . | |
| 88919 | 6/1982 | Japan | 72/56 |
| 76628 | 10/1982 | Japan . | |
| 82228 | 5/1985 | Japan . | |
| 214830 | 9/1987 | Japan . | |
| 1692302 | 5/1990 | Russian Federation . | |
| 442124 | 10/1934 | United Kingdom . | |
| 2224965 | 5/1990 | United Kingdom . | |

*Primary Examiner*—David Jones
*Attorney, Agent, or Firm*—Sheridan Ross P.C.

[57] ABSTRACT

The present invention provides an apparatus for shaping/embossing thin-walled work pieces, and is particularly apt for realizing complex and non-uniform shapes/designs in cylindrical metal container bodies. In one application, at least one pressurized fluid stream is ejected directly against one side of container body sidewall with a configured surface provided on the other side of the container body sidewall to achieve the desired shaping/embossing. At least one of the pressurized fluid stream and configured surface may be disposed for rotational and/or longitudinal motion. Such driven motion can be utilized to achieve progressive helical working of a cylindrical metal container body, thereby yielding the desired shaping/embossing.

59 Claims, 8 Drawing Sheets

U.S. PATENT DOCUMENTS

| | | | |
|---|---|---|---|
| 3,383,890 | 5/1968 | Wildi | 72/56 |
| 3,459,028 | 8/1969 | Bijovoet | 72/393 |
| 3,461,699 | 8/1969 | Roth | 72/56 |
| 3,555,866 | 1/1971 | Roth | 72/56 |
| 3,556,032 | 1/1971 | Fraze | 113/120 |
| 3,557,590 | 1/1971 | Erlandson | 72/56 |
| 3,559,434 | 2/1971 | Keinanen | 72/56 |
| 3,559,435 | 2/1971 | Gerber | 72/56 |
| 3,566,648 | 3/1971 | Norin et al. | 72/56 |
| 3,572,073 | 3/1971 | Dean et al. | 72/62 |
| 3,572,271 | 3/1971 | Fraze | 133/120 |
| 3,593,551 | 7/1971 | Roth et al. | 72/56 |
| 3,599,461 | 8/1971 | Astl | 72/56 |
| 3,613,423 | 10/1971 | Nakamura | 72/61 |
| 3,631,699 | 1/1972 | Roth | 72/56 |
| 3,688,535 | 9/1972 | Keinanen et al. | 72/56 |
| 3,698,337 | 10/1972 | Brawner et al. | 113/120 AA |
| 3,736,846 | 6/1973 | Frandenberg | 93/82 |
| 3,742,746 | 7/1973 | Erlandson | 72/56 |
| 3,757,555 | 9/1973 | Blutt et al. | 72/63 |
| 3,774,559 | 11/1973 | Kindelvich et al. | 113/1 G |
| 3,797,294 | 3/1974 | Roth | 72/56 |
| 3,800,578 | 4/1974 | Brennan et al. | 72/56 |
| 3,807,209 | 4/1974 | Aschberger et al. | 72/63 |
| 3,810,372 | 5/1974 | Queyroix | 72/56 |
| 3,810,373 | 5/1974 | Queyroix | 72/56 |
| 3,842,631 | 10/1974 | Aschberger et al. | 72/63 |
| 3,857,265 | 12/1974 | Howeler et al. | 72/56 |
| 3,858,422 | 1/1975 | Tominaga et al. | 72/56 |
| 3,919,871 | 11/1975 | Amdrasev et al. | 72/55 |
| 3,953,994 | 5/1976 | Brawner et al. | 72/58 |
| 3,974,675 | 8/1976 | Tominaga | 72/56 |
| 4,265,102 | 5/1981 | Shimakata et al. | 72/58 |
| 4,282,734 | 8/1981 | Eddy | 72/58 |
| 4,320,644 | 3/1982 | Fischer | 72/75 |
| 4,354,371 | 10/1982 | Johnson | 72/61 |
| 4,392,292 | 7/1983 | Irons | 72/61 |
| 4,455,852 | 6/1984 | Paton et al. | 72/82 |
| 4,619,129 | 10/1986 | Petkov et al. | 72/56 |
| 4,723,430 | 2/1988 | Hahn | 72/54 |
| 4,791,796 | 12/1988 | Ford | 72/62 |
| 4,901,557 | 2/1990 | Schmidt | 72/370 |
| 4,947,667 | 8/1990 | Gunkel et al. | 72/56 |
| 4,989,434 | 2/1991 | Brossia et al. | 72/82 |
| 5,022,254 | 6/1991 | Kramer | 72/393 |
| 5,040,682 | 8/1991 | Palisin, Jr. et al. | 206/519 |
| 5,048,408 | 9/1991 | Leftault, Jr. et al. | 72/56 |
| 5,160,031 | 11/1992 | Palisin, Jr. et al. | 206/519 |
| 5,187,962 | 2/1993 | Bilko et al. | 72/62 |
| 5,261,261 | 11/1993 | Ramsey | 72/105 |
| 5,275,033 | 1/1994 | Riviere | 72/62 |
| 5,293,765 | 3/1994 | Nussbaum-Pogacnik | 72/42 |
| 5,349,837 | 9/1994 | Halasz | 72/94 |
| 5,353,617 | 10/1994 | Cherian et al. | 72/56 |
| 5,357,774 | 10/1994 | Klages et al. | 72/62 |
| 5,372,028 | 12/1994 | Brilman et al. | 72/117 |
| 5,419,171 | 5/1995 | Bumgarner | 72/62 |

METAL CONTAINER BODY SHAPING/ EMBOSSING

FIELD OF THE INVENTION

This application relates to the shaping and embossing of thin-walled work pieces, and more particularly, to the shaping and embossing of metal container bodies utilizing a pressurized fluid stream directed immediately thereagainst.

BACKGROUND OF THE INVENTION

Numerous techniques have been employed for forming thin-walled work pieces, including in particular, longitudinal welding and drawing/redrawing/ironing techniques used in forming three- and two-piece cylindrical metal container bodies, respectively. Subsequent modifications to metal container bodies can be achieved via die necking, roll or spin necking, and other secondary processes.

Die necking generally entails forcing the sidewall of a container body and an external die against one another, typically by relative longitudinal advancement of the container body through a concentric outer die. In roll and spin necking the sidewall of a container body is contacted by an external roller, and in some instances an internal roller, that can be contoured and/or radially/axially advanced to neck the container body. Recently, symmetric longitudinal flutes or ribs, and diamond, waffle and numerous other patterns have been imparted to cylindrical container bodies through the use of either an internal roller and an external compliant mat, or by an internal roller and a matching external rigid forming element. Expanding manderals have also been utilized on three-piece metal container bodies to impart such patterns.

The noted techniques are limited as to the diametric extent and complexity of shaping that can be achieved. By way of example, die-necking cannot readily be employed for current aluminum drawn and ironed beverage containers (e.g., containers having a sidewall thickness of about 4–7 mil.) to achieve diametric changes of more than about 3% in any single operation and does not generally allow for container diameters to be increased then decreased (or vice-versa) or for discontinuous/angled designs to be shaped along the longitudinal extent of a container body. While spin forming techniques have been found to allow for relatively high degrees of expansion (e.g., in excess of 15% for current aluminum drawn and ironed beverage containers), relative rotation between a container body and the forming roller is necessary, thereby restricting the ability to achieve non-circular cross-sections along the longitudinal extent of a container body.

Other proposed techniques also have limitations. For example, electromagnetic and hydrostatic processes have been considered which entail the use of magnetic fields and pressurized vessels, respectively, to force a container body sidewall outward against an outer shaping die. Both processes require, however, a container body to be of sufficient ductility to withstand substantial attendant plastic deformation without failure. For current drawn and ironed aluminum beverage containers, such deformation limits are believed to be less than 5% before failure is realized due to the limited ductility of the aluminum alloys utilized. While annealing such container bodies may provide sufficient ductility to allow a greater degree of metal deformation, it would lower the strength of the container bodies and require additional undesirable thermal processing.

SUMMARY OF THE INVENTION

It is an object of the present invention to provide an apparatus/method for shaping and embossing thin-walled work pieces such as container bodies, including in particular, the achievement of complex and non-uniform shapes/designs in the sidewalls of metal containers. It is a related objective to provide for such shaping and embossing capabilities in a manner which does not require subsequent annealing of the container bodies, including in particular cylindrical drawn and ironed, aluminum alloy containers.

The apparatus/method of the present invention realizes the foregoing objectives by employing at least one pressurized fluid stream (e.g., liquid) that is ejected directly against the sidewall of a container body to impart the desired shape/design. In this regard, the desired shape/design may be realized via relative predetermined movement between the container body and pressurized fluid stream, the use of a configured surface positioned adjacent to the container body sidewall (i.e., wherein the pressurized fluid stream(s) work the sidewall towards the configured surface), predetermined variable control of the pressure of the fluid stream, and various combinations and subcombinations thereof.

It is important to note that the utilization of a directed pressurized fluid stream(s) allows for localized working metal container body sidewalls to achieve high degrees of metal deformation (e.g., exceeding 15% for current drawn and ironed aluminum container bodies). In particular, by providing relative longitudinal and rotational movement of the pressurized fluid stream and container body, localized working may progress in a helical fashion about and along a container body.

The present invention allows for the achievement of complex and non-uniform shapes/designs, including geometric shapes/designs (e.g., diamonds, triangles, company logos, etc.), lettering (e.g., product/company names, etc. in block print, script, etc.) and fanciful shapes/designs having angled and/or arcuate shape-defining edges and/or surfaces that vary around, about and along the longitudinal extent of a container body. As should be appreciated, the realization of such shaping/embossing capabilities allows for marked product differentiation, aesthetically tailored designs for targeted purchasers, and other significant marketing-related opportunities in consumer product markets where such opportunities have heretofore been quite limited. By way of primary example, the ability to provide metal containers for soft drinks, beer, and other beverages with shapes/designs that match and even exceed that previously realized in glass bottles may well reshape the industry. Indeed, it is believed that the present invention will enhance existing products and create entirely new product opportunities.

In one aspect of the present invention, a shape-defining means and spray means provide a configured surface and pressurized fluid stream(s), respectively, with at least one of the two being rotatable relative to the other to achieve progressive localized working (e.g., around a cylindrical container body sidewall). In this regard, it is preferable to dispose the spray means for rotation about the center axis of the container body. Specifically, the spray means may be advantageously provided on and directed outward for rotation about the container body center axis. Alternatively, the spray means can be on or offset from the center axis with the pressurized fluid stream(s) directed either outward and/or inward and the shape-defining means disposed for rotation thereabout together with the container body.

In a related aspect of the present invention, a shape-defining means and spray means provide a configured surface and pressurized fluid stream(s), respectively, with at least one of the two being longitudinally movable relative to the other to achieve progressive working (e.g., along the longitudinal extent of a cylindrical container body sidewall). In this regard, it is preferable to dispose the spray means to provide for longitudinal advancement and retraction on or parallel to the center axis of the container body. More particularly, the spray means may be advantageously directed outward from and disposed on the container body center axis for longitudinal advancement/retraction thereupon. Alternatively, the spray means can be on or offset from the center axis with the pressurized fluid stream(s) directed outward and/or inward and the shape-defining means disposed for longitudinal advancement/retraction parallel thereto together with the container body.

In another aspect of the present invention, a spray means is provided that includes at least one spray member (e.g., a fluid nozzle) spaced a predetermined distance from the container body sidewall to eject the pressurized fluid stream directly thereagainst to achieve the desired shaping. Additionally, the spray means may advantageously include a plurality of spray members (e.g., fluid nozzles) to eject a corresponding plurality of pressurized fluid streams. Each spray member preferably acts to accelerate a fluid stream supplied via a common fluid channel to provide a corresponding pressurized fluid stream. It may be preferable to longitudinally space the spray members along and aim the spray members in differing directions relative to an axis coincidental or parallel to the container body center axis for enhanced container working and/or efficiencies. For example, where n spray members are utilized on a container body center axis, it may be preferable to aim a spray member outward each 360/n° degrees, as viewed along the center axis (e.g., if n=4 aim nozzles outward at 0°, 90°, 180° and 270°). Further, as viewed from a side of a given axis, it may be preferable for one or more of the spray members to be directed primarily outward (e.g., between about +30° to −30° relative to an axis normal to the container body center axis, and more preferably between about +15° to −15° relative to such normal axis) angled toward one end of the container body (e.g., between about +15° to +75°, relative to an axis normal to the container body center axis, and more preferably between about +30° to +60° relative to such normal axis) and/or angled toward the other end of the container body (e.g., between about −15° to −75° relative to an axis normal to the container body center axis, and more preferably between about −30° to −60° relative to such normal axis). Such varying orientations can be utilized to provide pressurized fluid streams having non-parallel center axes, thereby yielding differing force, or shaping/embossing working vectors, for enhanced container working (e.g., by providing a shaping force vector near normal to any given region of a configured surface utilized for shaping/embossing).

Further, it may be advantageous to angle a spray member toward one end of a container body (e.g., between about +30° to +60° relative to an axis normal to the container body center axis) in order for the corresponding pressurized fluid stream to reach a portion of a container body that may not otherwise be accessible (e.g., the bottom end of a domed, drawn and ironed, aluminum container body inverted for shaping operations). Further, it may be advantageous to have a spray member angled toward the other end of the container body (e.g., between about −30° to −60° relative to an axis normal to the container body center axis) to facilitate removal of the fluid utilized for shaping (e.g., when an open end of a container body is oriented downward for gravity fluid flow).

For current drawn and ironed, aluminum container applications it is believed preferable to provide a pressurized fluid stream having a pressure of between about 1,000 psi and 10,000 psi and even more preferably between about 2,000 psi and 5,000 psi. Additionally, in such applications, it is currently believed preferable to space the spray means at least about ¼", and most preferably between about ¼" to ½", from the container body sidewall. Relatedly, it is currently believed preferable to maintain the width of the pressurized fluid stream at about 40 thousandths inch to about 60 thousandths inch.

In yet another aspect of the present invention, the shape-defining means comprises a die assembly having a plurality of separable die members, and preferably three or more die members to facilitate positioning and removal of a container body from a shaping/embossing location without damage to any decorative or internal coatings previously applied thereto. In this regard, it is also preferable to dispose each die member for radial advancement and retraction relative to the center axis of the container body. Further, it is preferable for the configured surface collectively defined by the die members of the die assembly to comprise selected portions for capturing, engaging and positioning corresponding portions of the container body to be shaped/embossed (e.g., the necked and/or flanged top portion and reduced bottom end portion of a drawn and ironed metal container body).

Preferably, the die assembly is disposed outside and around the container body to be shaped/embossed, with a spray means disposed inside of the container body. Further, and as will be appreciated, the shape-defining means should maintain a constant position relative to a container body once positioned for shaping/embossing operations. As noted, while it is generally preferred to provide for the rotation and/or longitudinal advancement/retraction of the spray means relative to the shape-defining means (e.g., to reduce the amount of physical mass and weight to be moved), there may be applications where rotation and/or longitudinal advancement/retraction of the shape-defining means relative to the spray means, or rotation and/or longitudinal advancement/retraction of both the shape-defining means and spray means proves desirable.

Additionally, while it generally believed preferable to dispose the shape-defining means outside of the container body for shaping/embossing operations, there are applications where it is preferable to position one or more die members adjacent to the inside surface of a container body with a spray means opposingly positioned on the outside of the container body. For example, such an arrangement may be particularly attractive where a company or product name or logo is to be inwardly embossed.

In use, the present invention broadly encompasses a container-forming process that includes the steps of forming a metal container body, optionally applying at least one of either internal coating or decorative coating to the formed container body, and subsequently by shaping/embossing the container body in accordance with one or more of the above-described aspects of the present invention. As will be appreciated, the forming step may comprise conventional techniques for forming cylindrical, two-piece drawn and ironed aluminum alloy beverage container bodies, as well as weld-based techniques for forming cylindrical, three-piece steel container bodies. Further, such forming step may include various necking, flanging, doming and other known forming techniques currently employed in the container art. Similarly, the step(s) of applying an internal and/or external coating(s) may include conventional spraying techniques and other known approaches utilized in the art.

With particular respect to the shaping/embossing methodology of the present invention, key aspects include creating a pressurized fluid stream, directing the pressurized fluid stream directly against one side of a thin wall of a container body, and moving at least one of the container body or fluid stream and/or disposing a configured surface on the other side of the thin-wall work piece in opposing relation to a pressurized fluid stream wherein the work piece is shaped/embossed between the pressurized fluid stream and configured surface. Additional specific shaping/embossing steps include rotating and/or longitudinally advancing and/or retracting at least one of the pressurized fluid stream and container body relative to the other for shaping/embossing. In this regard, it is again noted that such relative rotation and longitudinal movement will combinatively and desirably yield progressive and incremental working of a container body in a helical fashion. It should be further appreciated that such working may be bi-directional or uni-directional and may include a predetermined number of successive longitudinal advancement and/or retraction steps. Finally, it is also noted that by selectively controlling in a predetermined variable manner, the pressure of the fluid stream in relation to the relative positioning of the fluid stream and container body (i.e., longitudinally and laterally (e.g., by rotation), complex shaping may be achieved apart from the use of a configured surface. Other variations, adaptations and advantages of the present invention will be appreciated by those skilled in the art.

DETAILED DESCRIPTION OF ONE EMBODIMENT

Figure 1A:
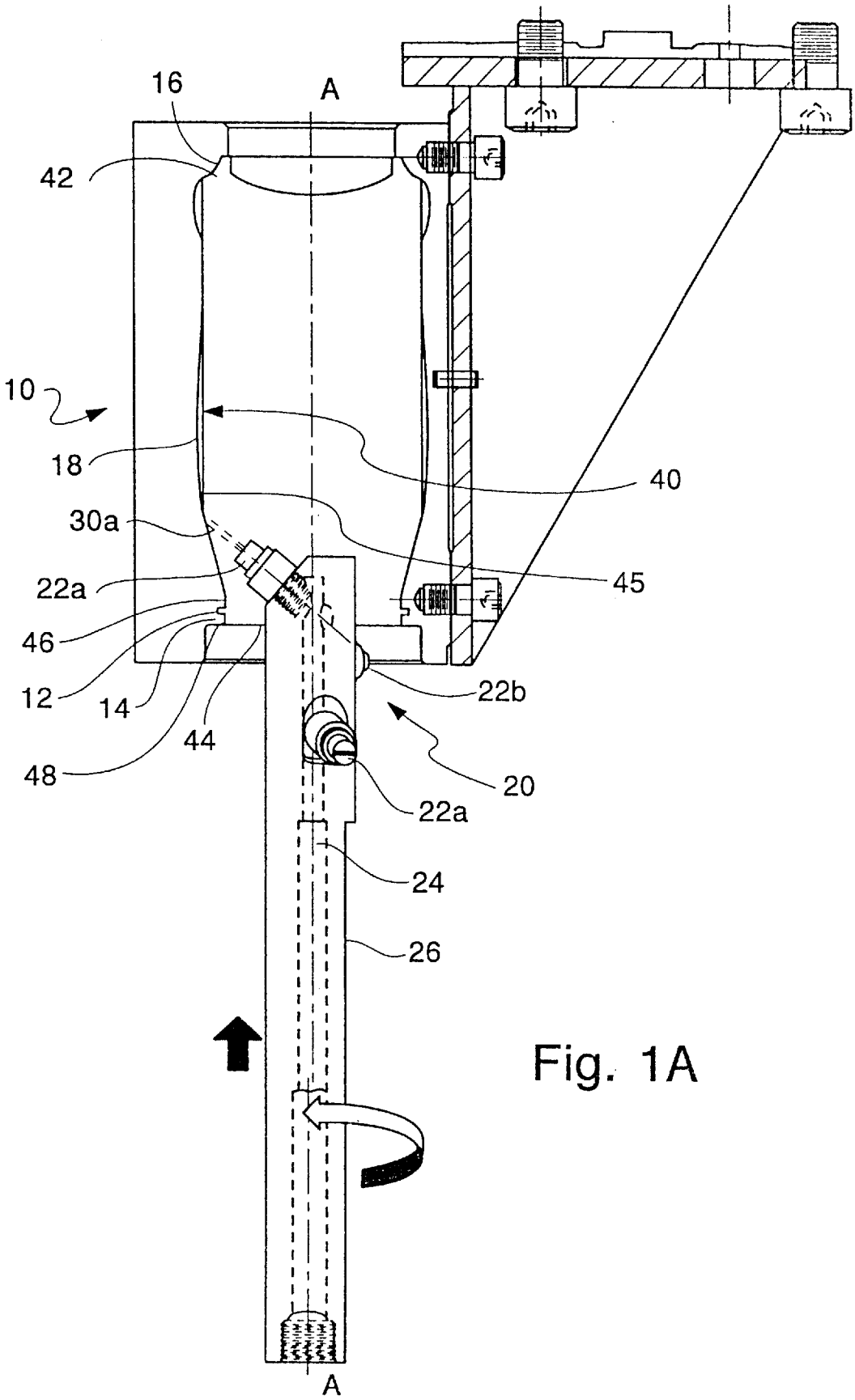
FIGS. 1A–1D are cross-sectional side views illustrating the operation of one embodiment of the present invention.
Figure 1B:
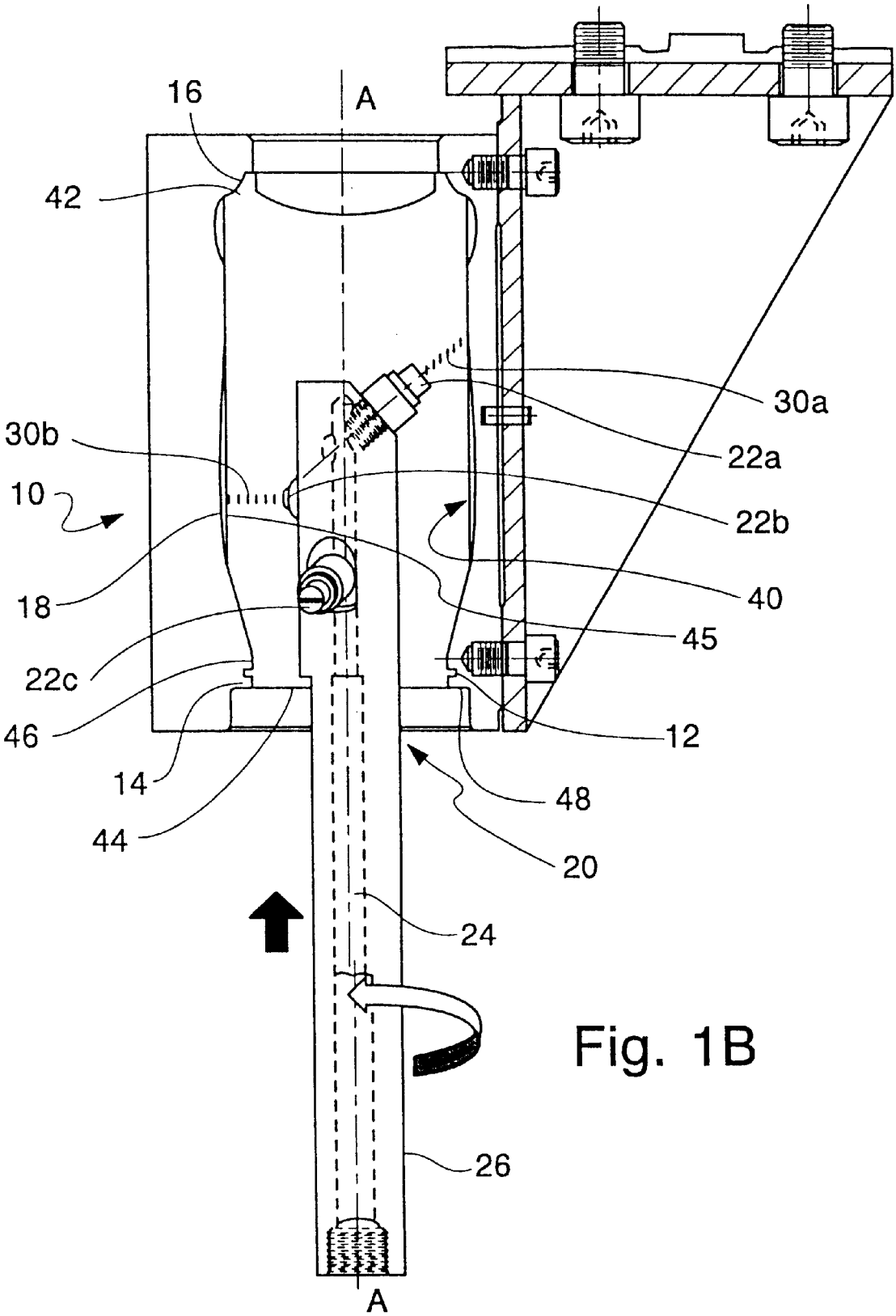

The embodiment illustrated in FIGS. 1A–1D is for use in shaping/embossing aluminum, drawn and ironed, cylindrical container bodies. Such embodiment includes a die assembly 10 and spray assembly 20 disposed for reciprocal longitudinal advancement/retraction along and rotation about center axis AA of container body 40.

Spray assembly 20 includes three longitudinally-spaced nozzles 22*a*, 22*b*, 22*c* for receiving a liquid (e.g., water) stream through channel 24 (shown in dashed lines) of a wand member 26 and for accelerating the water stream to eject corresponding, pressurized liquid streams 30*a*, 30*b*, 30*c*. As illustrated, the three nozzles 22*a*, 22*b*, 22*c* are aimed outward from the center axis AA at differing angles (i.e., every 120° from axis AA), and are disposed at varying angles relative to center axis AA. In particular, nozzle 22*a* is oriented upward at about 45°, nozzle 22*b* is oriented directly outward, and nozzle 22*c* is directed downward at about 45°, so as to provide differing localized coverages and shaping force vectors, facilitate access to the annular bottom end portion 42 of container body 40, and enhance removal of liquid from the open top end 44 of container body 40.

In operation, a container body 40 is positioned in a cavity defined by at least two, and preferably three or more separable die members comprising die assembly 10 and collectively defining a configured surface 18. Engaging means 12 (e.g., resilient members inserted into corresponding grooves of the die members) is provided in die assembly 10 to supportably engage and position a necked-in portion 46 of container body 40. Further, a ledge 14 and reduced portion 16 are collectively defined by the die members of die assembly 10 to interface with flanged end 48 and bottom end 42 of container body 40, respectively, for positioning and retention purposes.

In the illustrated embodiment, the configured surface 18 defines the desired shape to be imparted to the sidewalls 45 of cylindrical container body 40. In this regard, the desired shaping may include surfaces and edges that are angulated and otherwise non-uniform around and along the cylindrical container body 40.

Shaping is initiated in the illustrated embodiment by the supply of liquid through channel 24 of wand member 26, and the longitudinal advancement and rotation of wand member 26 within the container body 40. It is believed that the pressurized fluid streams 30*a*, 30*b*, 30*c* should be ejected from nozzles 22*a*, 22*b*, 22*c* at a pressure of between about 1,000 psi and 10,000 psi, and more preferably between about 2,000 psi and 5,000 psi, to achieve effective working without degradation to internal coatings and/or external decoration applied to container body 40. In the illustrated embodiment, each pressurized stream 30*a*, 30*b*, 30*c* is of generally a cylindrical configuration. It is currently believed preferable for the diameter of the pressurized streams 30*a*, 30*b*, 30*c* to be about 40 thousandths to 60 thousandths inch.

Figure 1C:
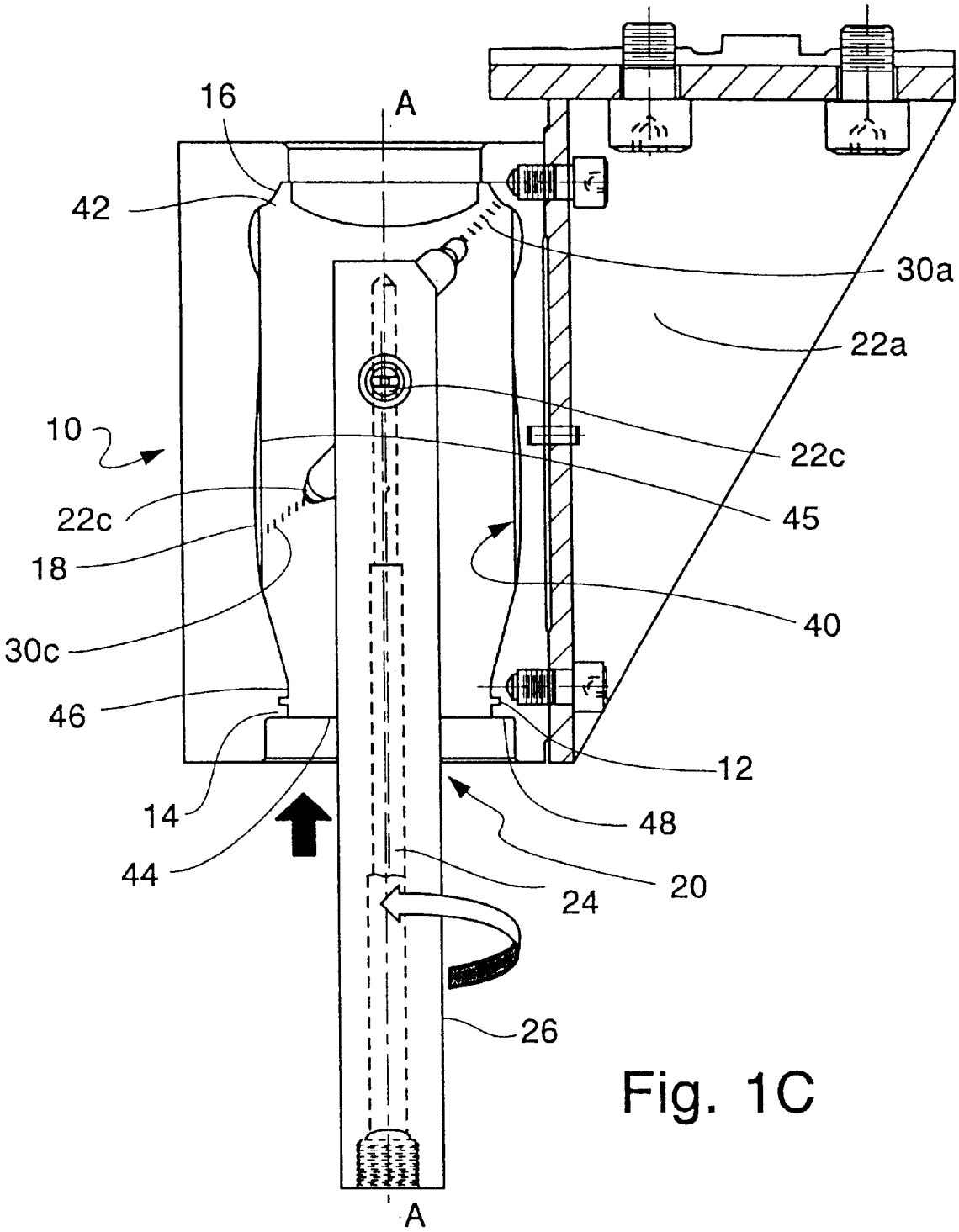
Figure 1D:
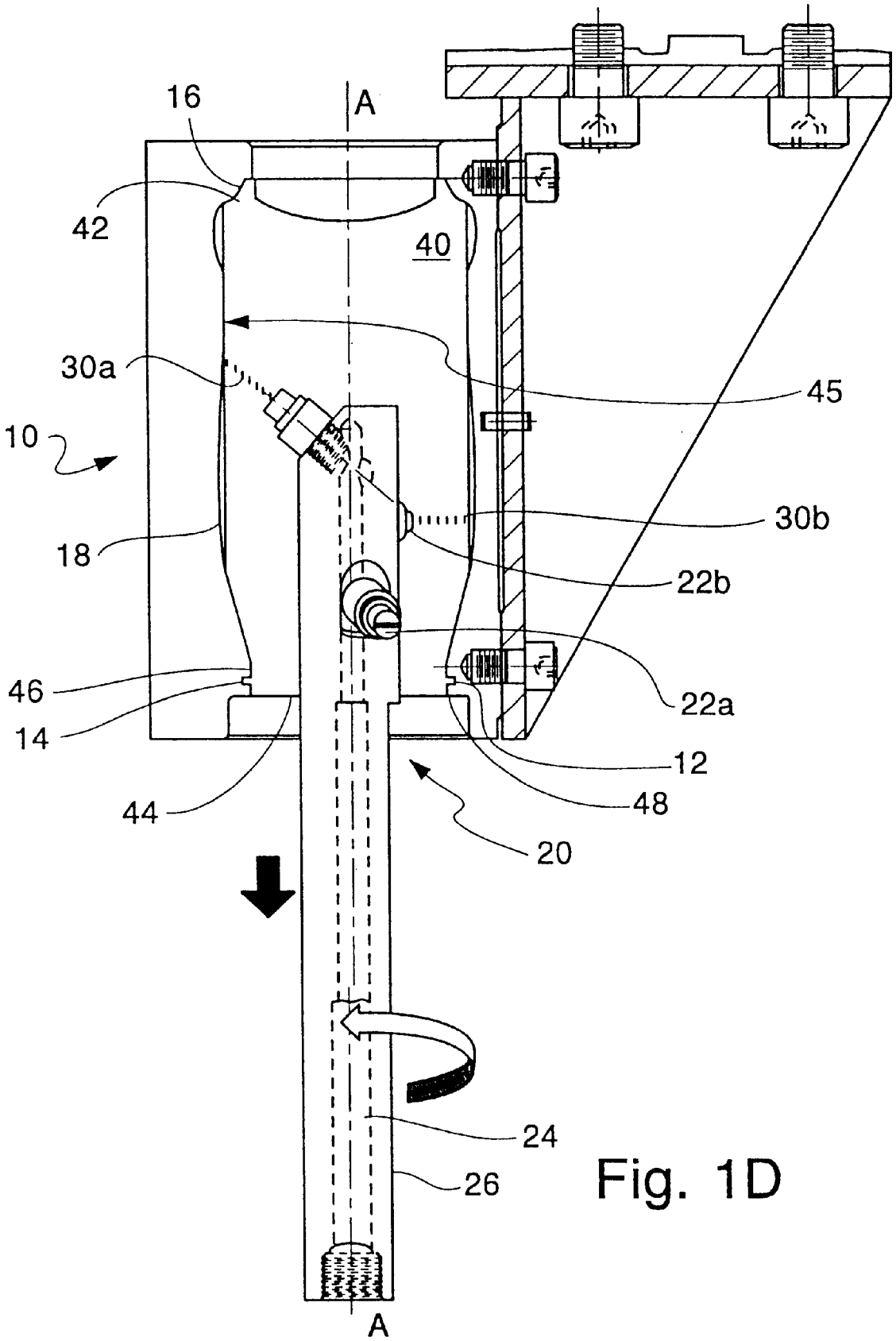

In FIG. 1A, wand member 26 has been longitudinally advanced such that nozzle 22*a* has initiated progressive helical working of container sidewall 45. As the wand member 26 rotates and continues its longitudinal ingress per FIG. 1B, pressurized fluid streams 30*b* and 30*c* ejected from nozzles 22*b* and 22*c* also progressively shape the container body sidewall in a helical fashion. As shown in FIG. 1C, as the wand member 26 reaches the end of its longitudinal travel nozzle 22*a* is able to achieve shaping in the bottom 42 of the container body 40 due to its upward angulation. FIG. 1*d* illustrates the continued working of the container body sidewall 45 during retraction of wand member 26. Throughout the shaping/embossing operation, it should be noted that the downward orientation of nozzle 22*c* will assist in removing the liquid utilized to form the pressurized fluid streams 30*a*, 30*b*, 30*c* from container body 40.

The longitudinal advancement and retraction of spray assembly 20 within container body 40 may be repeated for a predetermined number of iterations to complete the desired shaping/embossing. Further, the supply of liquid to spray assembly 20 may be controlled to provide for shaping/embossing only upon advancement or retraction of spray assembly 20 and/or any predetermined combination of advancements/retractions. Similarly, the rate and degree of shaping can be controlled by selectively controlling the rate of longitudinal travel and rotation of wand member 26, as well as by selectively controlling the flow rate of liquid supplied to the nozzles 22*a*, 22*b*, 22*c* (i.e., thereby selectively controlling the pressure of fluid streams 30*a*, 30*b*, 30*c*).

A laboratory bench-rig implementation will now be described with reference to FIG. 2. It should be appreciated, however, that the present invention is in no way limited to such laboratory bench-rig implementation. In this regard, for example, a production implementation of the present invention could include further automation of one or more of the operative components demonstrated by the laboratory bench-rig implementation to facilitate continuous processing.

Figure 2:
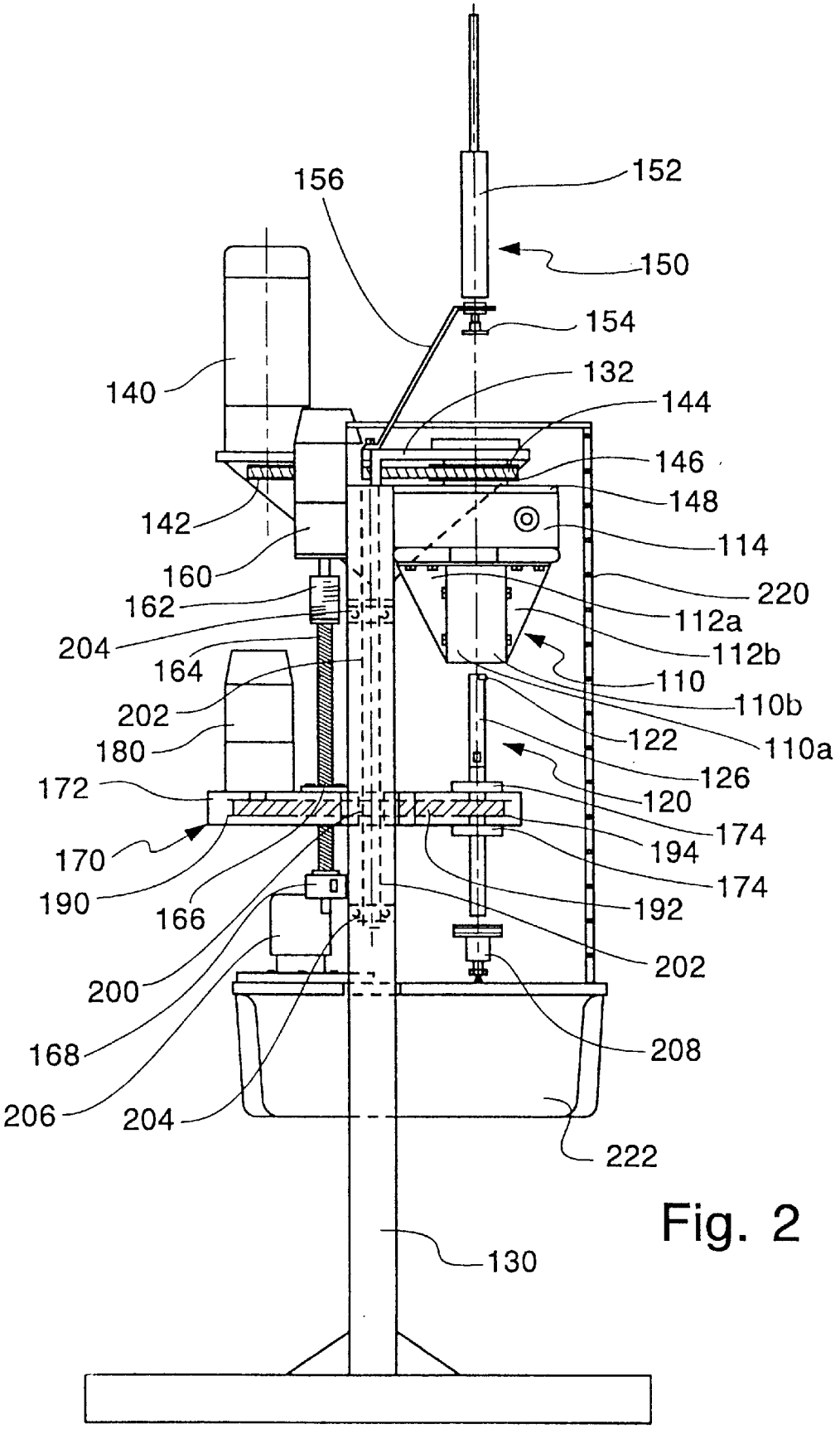
FIG. 2 is a side view illustrating a laboratory bench-rig.

In the laboratory bench-rig illustrated in FIG. 2, a die assembly 110 and spray assembly 120 are supportably interconnected to a common support frame 130. Die assembly 110 includes three die members two of which are shown as 110*a*, 110*b*, supportably interconnected via corresponding die supports (two shown) 112*a*, 112*b* to chuck 114. Chuck 114 internally includes a conventional worm gear arrangement (not shown) and thereby allowing the die assembly 110 to be opened and closed (e.g., for loading a container body therewithin) and rotatably driven (e.g., during shaping/embossing operations) by chuck motor 140 via pulleys 142, 146 and belt 147 therebetween. Further in this regard, chuck 114 engages chuck hub 148 and is supported. by support member 132 connected to frame 130.

A container body loading assembly 150, comprising a piston/cylinder member 152 with suction cup 154, support 156 and interconnected vacuum generator (not shown) is provided to supportably interface with the bottom (e.g., a domed bottom end) of a container body and to vertically advance/retract the container body into/from die assembly 110 for shaping/embossing operations.

Longitudinal travel of spray assembly 120 is provided by servo motor 160 mounted to frame 130 and interconnected to spray assembly 120 via coupling (i.e., servo screw) 162 to drive screw 164, which in turn supportably engages a carrier assembly 170 via threaded bushing 166. A servo screw pillow block 168 is provided at the bottom end of drive screw 164.

The carrier assembly 170 includes a main support 172 that extends through frame 130. Main support 172 carries a motor 180 at one end and is journaled via bearings 174 to a wand member 126 of spray assembly 120 at its other end. Motor 180 drives a pulley 190 positioned within support 172. In turn, pulley 190 is interconnected via drive belt 192 to pulley 194 that is positioned within support 172 and connected to wand member 126 so as to provide driven rotary motion to spray assembly 120 upon operation of motor 180. For alignment and stability, bushings 200 (one shown), interconnected to support 172, interface with linear shafts 202 (one shown) mounted to frame member 130 via linear shaft retainers 204. In operation, servo motor 160 turns drive screw 164 to advance or retract spray assembly 120 as desired. Further, motor 180 operates to drive pulleys 190 and 194, via drive belt 192, thus effecting rotation of the spray assembly 120 in a predetermined and variable manner as desired.

Liquid is supplied to the wand member 126 of spray assembly 120 via a high pressure pump (not shown) interconnected to wand member 126 via rotary union 208. The high pressure pump can be variably controlled in a predetermined manner to coordinate the pressure of the fluid stream eject by nozzle 122 with the relative positioning of nozzle 122 and die assembly 110 as desired for shaping/embossing. Shielding 220 and water capture 222/pressure pump 206 are provided in the prototype implementation to deflect and remove, respectively, water utilized in the shaping/embossing process.

Figure 3:
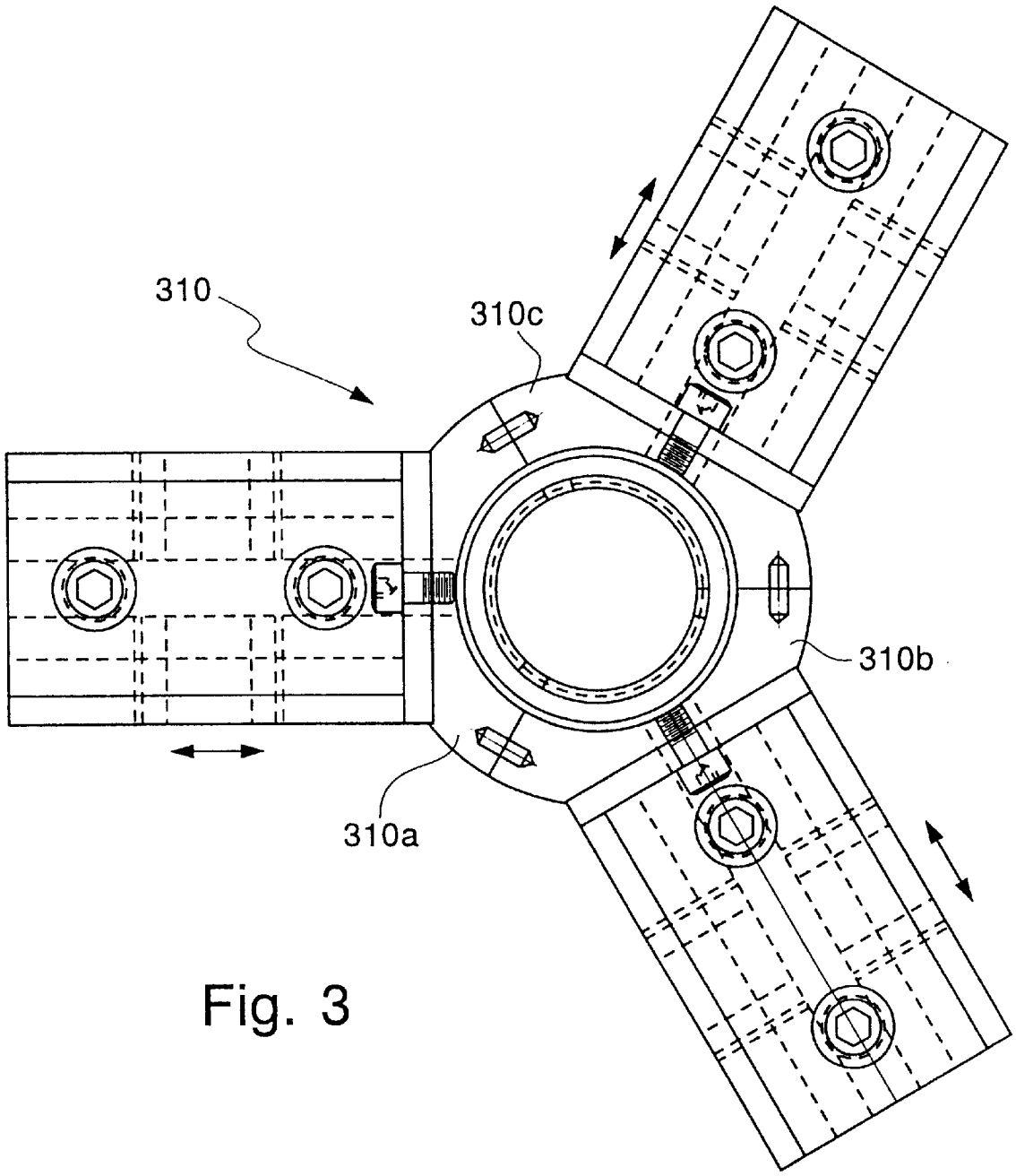
FIG. 3 is a top view of a three-die arrangement useful in a production implementation of the present invention.

FIG. 3 illustrates a die assembly 310 having three die members 310*a*, 310*b*, 310*c* which are each disposed for radial advancement into the position illustrated for shaping/embossing operations, and retraction for removal of a shaped/embossed container body and loading of the next cylindrical container body to be shaped. It is believed that provision of three or more die members in such a retractable arrangement will reduce undesirous scratching or other contact between the external sidewall surface of a container body and the inner surfaces presented by die assembly 310 upon completion of shaping/embossing operations. More generally, and as noted above, it should be appreciated that in a production implementation of the present invention, the initial positioning of container bodies, advancement/retraction of die assemblies, advancement/retraction of spray assemblies, rotation of spray assemblies, supply of fluid to spray assemblies, and removal of shaped container bodies after completion of shaping/embossing operations can be automated.

Figure 4B:
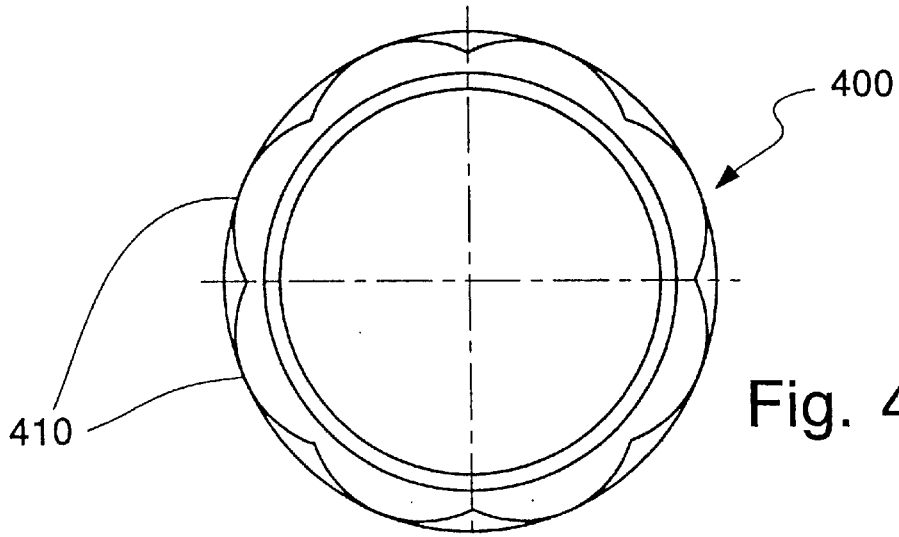
FIGS. 4A and 4B, and FIGS. 5A and 5B, illustrate side and top views of two different container bodies having different complex shapes and designs achievable through use of the present invention.
Figure 4A:
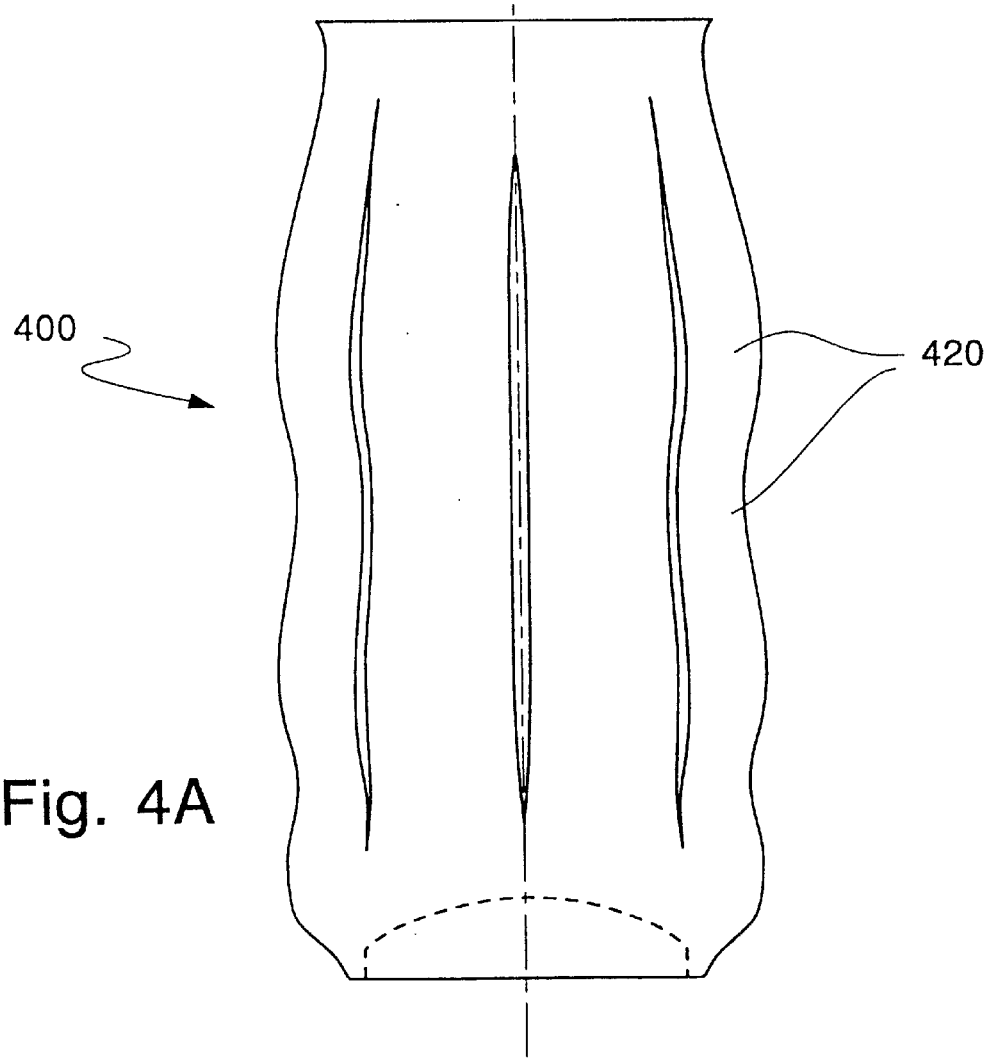
Figure 5B:
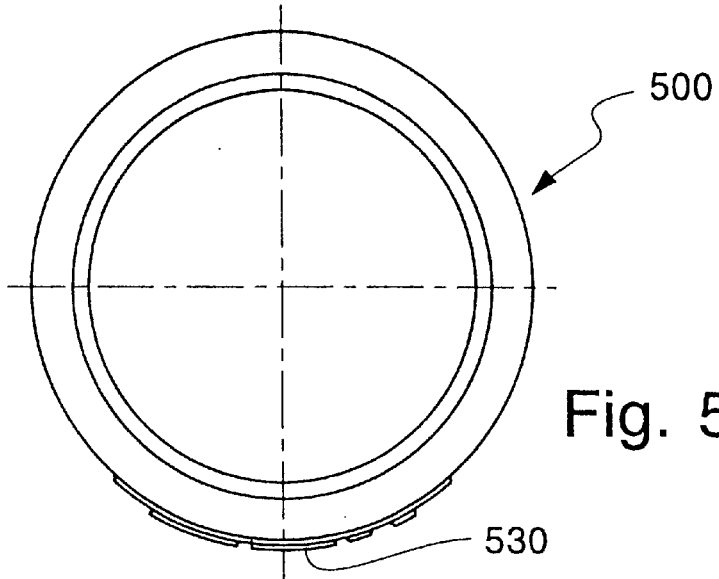
Figure 5A:
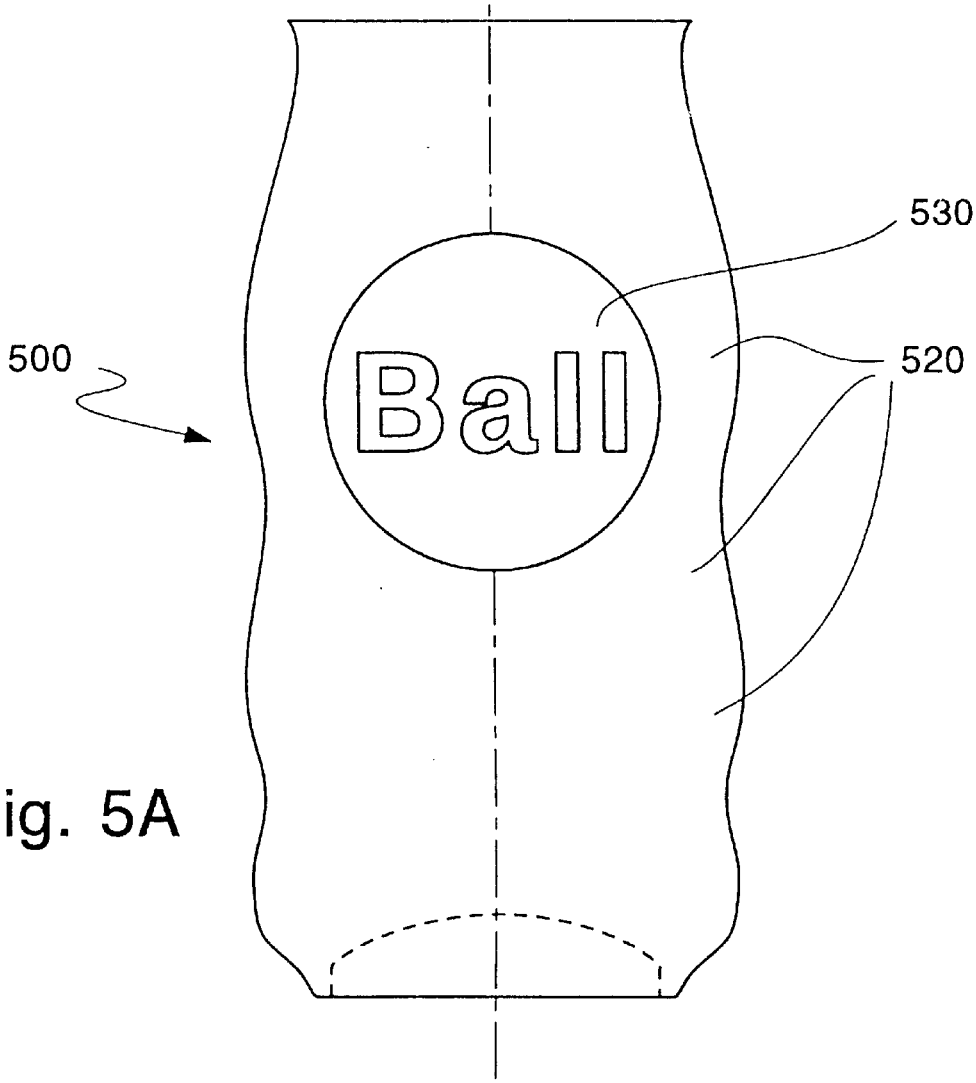

FIGS. 4A–4B and FIGS. 5A–5B illustrate two container body configurations achievable through use of the present invention. More particularly, FIGS. 4A and 4B illustrate a container body 400 having vertical ribs 410 and surfaces of revolution 420. As shown, the diameter of the ribs 410 (relative to the center axis of container body 400) varies along the vertical extent of the container body 400. FIGS. 5A and 5B illustrate a container body 500 having surfaces of revolution 520 and a company name/logo 530 selectively embossed in a sidewall thereof.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A metal container shaping apparatus comprising:

a shape-defining means having at least one configured surface defined using at least two separable die members positionable adjacent to a metal, thin sidewall of a drawn and ironed container body having a longitudinal extent; and spray means for directing a pressurized fluid stream against a selected portion of said metal thin sidewall of said container body to force said selected portion toward at least one of said at least two die members of said shape-defining means, to provide local working of at least said selected portion into a predetermined configuration between said pressurized fluid stream and said at least one of said at least two die members and in which said spray means and said container body move relative to each other in a direction along said longitudinal extent during said local working, with at least portions of said spray means being inside said metal container body during at least some of the time said selected portion is shaped into said predetermined configuration.

2. The apparatus as recited in claim 1, wherein said spray means is rotatable relative to said shape-defining means about a center axis of a container body.

3. The apparatus as recited in claim 1, further comprising:

means for longitudinally moving one of said shape-defining means and spray means relative to the other of said shape-defining means and spray means.

4. The apparatus as recited in claim 1, wherein said spray means is longitudinally movable relative to said shape-defining means along a center axis of a container body.

5. The apparatus as recited in claim 1, wherein said pressurized fluid stream comprises a liquid supplied to said spray means.

6. The apparatus as recited in claim 1, wherein the shape of said fluid stream is substantially maintained between said spray means and contact with the container body.

7. The apparatus as recited in claim 1, wherein said pressurized fluid stream has a predetermined minimum pressure of about 1,000 psi.

8. The apparatus as recited in claim 1, wherein said pressurized fluid stream has a predetermined maximum pressure of about 10,000 psi.

9. The apparatus as recited in claim 8, wherein said pressurized fluid stream has a predetermined pressure of between about 2,000 psi and 5,000 psi.

10. The apparatus as recited in claim 1, said spray means comprising at least one spray member spaced a predetermined distance of at least about ¼" from the selected portion of the container body.

11. The apparatus as recited in claim 1, said spray means comprising:

a plurality of longitudinally-spaced spray members.

12. The apparatus as recited in claim 11, wherein each of said spray members accelerate a fluid supply stream supported thereto.

13. The apparatus as recited in claim 1, said shape-defining means comprising:

at least three die members.

14. The apparatus as recited in claim 13, wherein said at least three die members are positioned around said spray means.

15. The apparatus as recited in claim 14, further comprising:

means for moving said die members inward and outward relative to spray means.

16. The apparatus as recited in claim 13, wherein:

said metal container body has a thickness of about 4–7 mils.

17. The apparatus as recited in claim 1, wherein said predetermined configuration includes a shape that is non-uniform around and along said container body.

18. A metal container shaping apparatus comprising:

a shape-defining, means having at least one configured surface defined using at least two separable die members positionable adjacent to a metal, thin sidewall of a drawn and ironed container body having a longitudinal extent;

spray means for directing a pressurized fluid stream against a selected portion of said metal thin sidewall of said container body to force said selected portion toward at least one of said at least two die members of said shape-defining means, wherein said selected portion is shaped into a predetermined configuration between said pressurized fluid stream and said at least one of said at least two die members and in which said spray means and said container body move relative to each other in a direction along said longitudinal extent, with at least portions of said spray means being inside said metal container body during at least some of the time said selected portion is shaped into said predetermined configuration; and means for rotating one of said shape-defining means and spray means relative to the other of said shape-defining means and spray means.

19. A metal container shaping apparatus comprising:

a shape-defining means having at least one configured surface defined using at least two separable die members positionable adjacent to a metal, thin sidewall of a drawn and ironed container body having a longitudinal extent; and spray means for directing a pressurized fluid stream against a selected portion of said metal thin sidewall of said container body to force said selected portion toward at least one of said at least two die members of said shape-defining means, wherein said selected portion is shaped into a predetermined configuration between said pressurized fluid stream and said at least one of said at least two die members and in which said spray means and said container body move relative to each other in a direction along, said longitudinal extent, with at least portions of said spray means being inside said metal container body during at least some of the time said selected portion is shaped into said predetermined configuration;

wherein said spray means comprises a plurality of spray members, at least a first of which is angled upward and at least a second of which is angled downward.

20. A metal container shaping apparatus comprising:

a die assembly having a plurality of die members, with each of said plurality of die members being separable from each other;

a configured die cavity for receiving a cylindrical thin sidewall of a drawn and ironed metal container body having an upper end portion and a lower end portion and with a central, longitudinal axis therewithin, wherein said container body is held using said die assembly along at least at one said upper end portion and said lower end portion in a radial direction from said central, longitudinal axis;

spray means for ejecting at least one pressurized fluid stream and positionable adjacent to said die assembly;

means for longitudinally advancing and retracting said spray means relative to said die assembly, wherein at least portions of said spray means advance and retract while being inside of said container body; and means for rotating said spray means relative to said die assembly.

21. A metal container shaping apparatus as recited in claim 17, wherein said pressurized fluid stream is ejected at a pressure of at least about 2,000 psi.

22. A metal container shaping apparatus comprising:

support means for supporting a thin sidewall of a drawn and ironed container body having a central, longitudinal axis;

spray means including discharge means for directing a pressurized fluid stream directly against a selected portion of said container body; and means for moving at least one of said spray means and support means relative to the other in a predetermined manner to provide relative movement, wherein said selected portion of said container body is locally and progressively worked, during said relative movement, by said pressurized fluid stream into a predetermined configuration, wherein said discharge means is disposed at a first angle relative to a reference plane that is perpendicular to said central, longitudinal axis of said container body such that said pressurized fluid stream is directed against said selected portion at said first angle.

23. A metal container shaping apparatus as recited in claim 21, wherein said spray means is positionable on a first side of said selected portion of the container body, and further comprising:

a configured surface positionable on a second side of said selected portion of the container body in opposing relation to said pressurized fluid stream, wherein the pressurized fluid stream forces said selected portion toward said configured surface to define the predetermined configuration.

24. A metal container shaping apparatus comprising:

support means for supporting a thin sidewall of a drawn and ironed container body having a central, longitudinal axis;

spray means including discharge means for directing a pressurized fluid stream directly against a selected portion of said container body; and means for moving at least one of said spray means and support means relative to the other in a predetermined manner, wherein said selected portion of said container body is locally and progressively worked by said pressurized fluid stream into a predetermined configuration, wherein said discharge means is disposed at a first angle relative to a reference plane that is perpendicular to said central, longitudinal axis of said container body such that said pressurized fluid stream is directed against said selected portion at said first angle;

wherein said means for moving includes:

longitudinal advancement means for advancing one of said support means and spray means relative to the other in a predetermined manner; and rotational means for rotating one of said support means and spray means related to the other in a predetermined manner, wherein said localized working progresses in a helical manner along and about a longitudinal extent of a said selected portion of the container body.

25. A method for making a container, comprising the steps of:

forming a drawn and ironed container body comprising a generally cylindrical thin sidewall;

directing at least one fluid stream directly against a discrete portion of said container body while said container body to provide local working of at least said discrete portion while said container body is positioned within at least two members that are separable from each other;

changing a shape of said discrete portion of said container body using said directing step and during which at least portions of said one fluid stream are located inside of said container body; and separating said two members from each other after said changing step.

26. A method, as claimed in claim 25, wherein:

said forming step further comprises forming a bottom integrally interconnected with said sidewall.

27. A method, as claimed in claim 25, wherein:

said thin sidewall is in the range of 4–7 mils.

28. A method, as claimed in claim 25, further comprising the step of:

generating a fluid stream before said directing step.

29. A method, as claimed in claim 28, wherein:

said generating step comprises generating said fluid stream with a width ranging from about 0.040 inches to about 0.060 inches.

30. A method, as claimed in claim 28, wherein:

said generating step comprises pressurizing said fluid stream to a pressure ranging from about 1,000 psi to about 10,000 psi.

31. A method, as claimed in claim 28, wherein:

said generating step comprises pressurizing said fluid stream to a pressure ranging from about 2,000 psi to about 5,000 psi.

32. A method, as claimed in claim 25, wherein:

said directing step comprises directing a plurality of separate fluid streams against said container body, each said fluid stream acting directly on a different discrete portion of said container body.

33. A method, as claimed in claim 25, wherein:

said directing step comprises directing a first fluid stream against a first discrete portion of said container body and directing a second fluid stream against a second discrete portion of said container body, said first discrete portion being at a different location than said second discrete portion.

34. A method, as claimed in claim 25, wherein:

said directing step comprises directing a first fluid stream against a first discrete portion of said container body and directing a second fluid stream against a second discrete portion of said container body radially spaced from said first discrete portion.

35. A method, as claimed in claim 25, wherein:

said directing step comprises directing a first fluid stream against a first discrete portion of said container body and directing a second fluid stream against a second discrete portion of said container body longitudinally spaced from said first discrete portion.

36. A method, as claimed in claim 35, wherein:

said first discrete location is further radially spaced from said second discrete location.

37. A method, as claimed in claim 25, wherein:

said directing step comprises directing said fluid stream against said container body to form an angle between said fluid stream and said container body of about 90 degrees.

38. A method, as claimed in claim 26, further comprising the step of:

applying a coating to said interior surface before said directing step.

39. A method, as claimed in claim 25, wherein:

said directing step comprises using a spray assembly comprising at least one spray member.

40. A method, as claimed in claim 39, further comprising the step of:

moving said spray member relative to said container body.

41. A method, as claimed in claim 40, wherein:

said moving step comprises axially advancing said spray member relative to said container body.

42. A method, as claimed in claim 41, wherein:

said axially advancing step comprises axially advancing said spray member relative to said container body in a first direction and axially advancing said spray member relative to said container body in a second direction opposite said first direction.

43. A method, as claimed in claim 42, wherein:

said directing step is performed during at least a portion of said axially advancing said spray member relative to said container body in a first direction step.

44. A method, as claimed in claim 42, wherein:

said directing step is performed during at least a portion of both said axially advancing said spray member relative to said container body in a first and second direction steps.

45. A method, as claimed in claim 41, further comprising the step of:

controlling a rate of said axially advancing step.

46. A method, as claimed in claim 25, further comprising the step of:

controlling a pressure of said fluid stream during said directing step.

47. A method for making a container, comprising the steps of:

forming a drawn and ironed container body comprising a generally cylindrical thin sidewall;

directing at least one fluid stream directly against a discrete portion of said container body while said container body is positioned within at least two members that are separable from each other;

changing a shape of said discrete portion of said container body using said directing step and during which at least portions of said one fluid stream are located inside of said container body; and separating said two members from each other after said changing step;

wherein said directing step comprises directing a first fluid stream against a first discrete portion of said container body at a first angle relative to a reference plane which is perpendicular to a central, longitudinal axis of said container body and directing a second fluid stream against a second discrete portion of said container body at a second angle relative to said reference plane, said first angle being different than said second angle.

48. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

changing a shape of said discrete portion of said container body using said directing step and during which at least portions of said one fluid stream are located inside of said container body; and separating said two members from each other after said changing step;

wherein said directing step comprises directing said fluid stream against said container body to form an angle between said fluid stream and said container body other than 90 degrees.

49. A method for making a contained, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

changing a shape of said discrete portion of said container body using said directing step and during which at least portions of said one fluid stream are located inside of said container body; and separating said two members from each other after said changing step;

wherein said directing step comprise directing a plurality of separate fluid streams directly against said container body with different force vectors.

50. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

wherein said directing step comprises using a spray assembly comprising at least one spray member;

changing a shape of said discrete portion of said container body using said directing step and during which at least portions of said one fluid stream are located inside of said container body;

separating said two members from each other after said changing step;

moving said spray member relative to said container body; and controlling a rate of said moving step.

51. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

wherein said directing step comprises using a spray assembly comprising at least one spray member;

changing a shape of said discrete portion of said container body using said directing step and during which at least portions of said one fluid stream are located inside of said container body;

separating said two members from each other after said changing step;

moving said spray member relative to said container body;

wherein said moving step comprises rotating said spray member relative to said container body.

52. A method, as claimed in claim 51, further comprising the step of:

disposing a rotational axis of said spray assembly substantially on a central, longitudinal axis of said container body.

53. A method, as claimed in claim 51, further comprising the, step of:

disposing a rotational axis of said spray assembly in offset relation to a central, longitudinal axis of said container body.

54. A method, as claimed in claim 51, further comprising the step of:

controlling a rate of said rotating step.

55. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

wherein said directing step comprises using a spray assembly comprising at least one spray member;

changing a shape of said discrete portion of said container body using, said directing step and during which at least portions of said one fluid stream are located inside of said container body;

separating said two members from each other after said changing step;

moving said spray member relative to said container body;

wherein said moving step comprises axially advancing said spray member relative to said container body; and wherein said moving step further comprises rotating said spray member relative to said container body.

56. A method, as claimed in claim 55, further comprising the step of:

controlling a rate of both said axially advancing and said rotating steps.

57. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

wherein said directing step comprises using a spray assembly comprising at least one spray member;

changing a shape of said discrete portion of said container body using said directing step and during which at least portions of said one fluid stream are located inside of said container body;

separating said two members from each other after said changing step;

moving said spray member relative to said container body; and progressively changing a shape of said container body using said directing, changing, and moving steps.

58. A method, as claimed in claim 57, wherein:

said progressively changing step comprises helically changing a shape of said container body.

59. A method for making a container, comprising the steps of:

forming a drawn and ironed container body comprising a generally cylindrical thin sidewall;

directing at least one fluid stream directly against a discrete portion of said container body while said container body while said container body is positioned within at least two members that are separable from each other;

changing a shape of said discrete portion of said container body using said directing step and during which at least portions of said one fluid stream are located inside of said container body;

separating said two members from each other after said changing step; and varying a pressure of said fluid stream during said directing step.

* * * * *